US005110026A

United States Patent [19]

Messner

[11] Patent Number: 5,110,026

[45] Date of Patent: May 5, 1992

[54] APPARATUS FOR A STEPWISE ADVANCING OF A WEB-SHAPED WORKPIECE

[75] Inventor: Helmut Messner, Arbon, Switzerland

[73] Assignee: Bruderer AG, Frasnacht, Switzerland

[21] Appl. No.: 573,715

[22] Filed: Aug. 24, 1990

[30] Foreign Application Priority Data

Dec. 11, 1989 [CH] Switzerland ..... 4440/89

[51] Int. Cl.[5] ..... B65H 20/04; F16H 21/00

[52] U.S. Cl. ..... 226/152; 226/143; 226/154; 226/158; 74/49; 74/603

[58] Field of Search ..... 226/142, 143, 154, 158, 226/152; 74/49, 603, 604; 364/252, 260, 519

[56] References Cited

U.S. PATENT DOCUMENTS

| | | | |
|---|---|---|---|
| 3,784,075 | 1/1974 | Portmann | 226/35 X |
| 4,156,387 | 5/1979 | Portmann | 74/603 X |
| 4,800,777 | 1/1989 | Imanishi et al. | 74/604 |
| 4,979,476 | 12/1990 | Islas | 74/603 X |

*Primary Examiner*—Daniel P. Stodola
*Assistant Examiner*—P. Bowen
*Attorney, Agent, or Firm*—Ladas & Parry

[57] ABSTRACT

The crank assembly of the advancing apparatus is eccentrically supported in an intermediate shaft. This intermediate shaft is in turn supported in an oscillating slide. Accordingly, the oscillating movement of the slide is superimposed over such of the driving pivot of the crank assembly. The intermediate shaft includes a cam disk. Due to the cam disk the intermediate shaft oscillates in operation and causes in turn the oscillating movement of the slide, which oscillating movement proceeds oppositely to the oscillating movement of the driving pivot. The sum of these two movements in the zones of the end positions thereof is accordingly zero. Accordingly, the driving pivot is at rest over a prolonged time span. Due to this prolonged rest period between individual feeding steps, elastical deformations of working structures and of the workpiece being worked upon, can attenuate and fade out prior to the working proper, and at the same time the length of the advancing is not subjected to a change. Furthermore, any clamping elements for the clamping of the workpiece can be lowered more slowly against the workpiece such that a lower energy of impact is produced. Conclusively, the workpieces are not subjected to a plastic deformation. The apparatus finds application specifically in punch presses.

3 Claims, 3 Drawing Sheets

APPARATUS FOR A STEPWISE ADVANCING OF A WEB-SHAPED WORKPIECE

BACKGROUND OF THE INVENTION

1. Field of the Invention

The present invention relates to an apparatus for a stepwise advancing of a web-shaped workpiece, which apparatus includes two workpiece advancing units operative to clampingly receive a workpiece therebetween, of which two workpiece advancing units the first workpiece advancing unit is periodically movable towards the second workpiece advancing unit such to periodically clamp a workpiece therebetween and being periodically movable away from the second workpiece advancing unit such to release the workpiece, and which apparatus includes further a drive shaft and a first intermediate drive transmitting assembly driven by said drive shaft and drivingly connected to said first workpiece advancing unit, and a second intermediate drive transmitting assembly driven by said same drive shaft and drivingly connected to said second workpiece advancing unit.

2. Description of the Prior Art

Such apparatuses find application for instance as so-called feeding or advancing units in punch presses. They are used to slide a web-shaped workpiece stepwise through a punch press, whereby during the respective rest periods of the workpiece during this stepwise feeding the foreseen working thereof is made, such as stamping, embossing, etc. as known in the art.

The moving sequence of such apparatuses for a stepwise advancing of a web-shaped workpiece can be divided into a number of individual steps as follows. It shall be assumed that the upper workpiece advancing unit and the lower workpiece advancing unit comprise each an advancing roller structured in accordance with known designs, such as e.g. disclosed in the Swiss patent specification 543 932. In operation these two rollers make an oppositely directed oscillating movement. Hereby the lower roller or feeding roller, respectively, is stationary, which means it is rotatably supported in the respective frame of the machine and makes merely oscillating movements. The upper roller, i.e., feeding roller, makes the same oscillating movements as the lower feeding roller, is, however, additionally arranged such that it is movable towards the lower feeding roller and away thereof such to clamp and release, respectively, a respective workpiece. Accordingly, the upper feeding roller is subject to two movements, namely on the one hand to the oscillating movement and on the other hand to the up-and-down movement. The individual steps of the operation proceed as follows, whereby in order to simplify the explanation the action of the pressing bar, which as such is known in such apparatuses, is deleted. An initial state shall be assumed that the web-shaped workpiece is at rest and a stamping operation has just been terminated. The tool, i.e., its arresting or guiding, respectively, pins release the web. Now, the upper feeding roller which is not oscillating at this instance is lowered onto the web which accordingly is clamped between the upper feeding roller and the lower feeding roller which at this instance is also not rotating, at rest. The web is now clamped and now the two feeding rollers begin to rotate and push or feed, respectively, the web along a predetermined distance and come again to rest. The upper roller rises, the tool closes down onto the web and again one punching operation step is made. Simultaneously to this punching the upper roller which has been lifted off and the lower roller rotate in an opposite direction back into their initial position such that after an anewed releasing of the web by the tool, the next following feeding step can proceed.

For reasons of the disclosure, it shall be noted additionally that a variety of designs of such feeding apparatuses is known in the art. According to one design, both feeding rollers are driven. According to other designs only the lower feeding roller is driven and the upper feeding roller is supported for free rotation such that it is rotated only during the feeding step due to the counterforce generated during the clamping of the workpiece. A further design includes the so-called pliers or clamp feed. On this design an upper clamping part forming the jaw of the "pliers" is pressed for instance also by means of a roller against a lower, slide or carriage shaped part such that the web-shaped workpiece is clamped between these two parts, whereby the oscillating movement for the feeding of the workpiece and for the returning movement of the clamping pieces into their initial position proceeds rectilinearly.

The rollers or clamps, respectively, of these known feeding apparatuses are as a rule driven by means of crank drive assemblies. Due to this design of the drive the time of rest at the respective end position of the oscillating movement, i.e., during the time span of the reversing of the direction of the rotational movement or rectilinear movement, respectively, is extremely short and taken relative to the crank drive it amounts to only very few degrees of the angle. During this phase of movement or work, respectively, the acceleration and accordingly deceleration of the structural members being moved attain maximal values. Conclusively, the so-called dynamic deformation due to the elasticity of the respective structural units attains also the maximal value. Due to economical reasons, the rotational speed of punch presses is steadily increasing and accordingly the rotational speeds of the feeding apparatuses are also steadily increasing and accordingly the deformation of the parts of the apparatus as well as of the web-shaped workpiece is the longer the more subject to an increase. The seeming resting period is in high-speed punch presses so short that a complete attenuation or disappearance, respectively, of the elastic deformation of parts of the apparatus as well as of parts of the workpiece, although they may be extremely small, as well as a complete attenuation or disappearance, respectively, of possible oscillations of machine parts and of the workpiece can no longer occur completely. The result thereof is an unwanted change of the respective feeding length and also unprecise products.

Similar difficulties are encountered at the controlling of the movement of the clamping members or upper feeding rollers, respectively, which, as is well known, can only be lowered down onto the workpiece and raised off, respectively, therefrom during the time span when no feeding movement occurs. Due to the mentioned short resting phase, the respective clamping members (upper roller, clamp) must be lowered at an extremely high-speed down onto the workpiece. This leads, however, to a high striking or impinging speed, respectively, of a respective arresting member onto the workpiece, i.e. a high striking energy is present due to which specifically web-shaped workpieces consisting of a relatively soft material may be deformed plastically and accordingly permanently.

SUMMARY OF THE INVENTION

Accordingly, it is a general object of the present invention to provide an apparatus for a stepwise advancing of a web-shaped workpiece, by means of which the duration of the resting phase of the oscillating movements of the structural units involved in the advancing of the workpiece is extended.

A further object is to provide an apparatus for a stepwise advancing of a web-shaped workpiece, in which a first intermediate drive transmitting assembly comprises a cam drive driven by the drive shaft of the apparatus and is drivingly connected via a transmission rod assembly to a first workpiece advancing unit and operative to control the sequence of the movement of the first workpiece advancing unit against the second workpiece advancing unit and away therefrom, and where the second intermediate drive transmitting unit comprises a crank assembly having a driving pivot and being supported such in an intermediate shaft, which is drivingly connected to the drive shaft to be driven therefrom, that the driving pivot which is operative to drive the second workpiece advancing unit executes in operation an oscillating movement, which intermediate shaft is supported in a slide which is oscillatory opposite to the oscillating movement of the driving pivot.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 2:
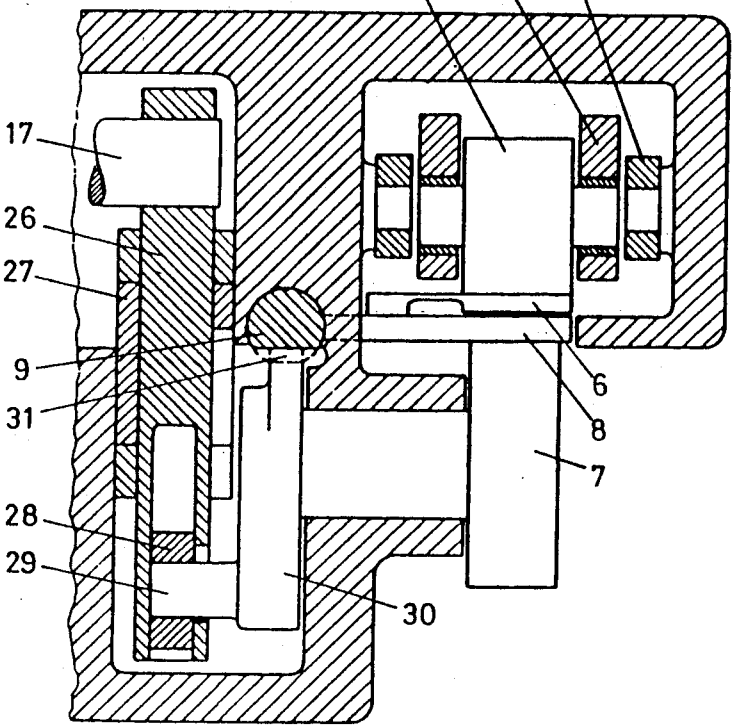
FIG. 2 is a sectional view of the feeding unit of FIG. 1 rotated by 90°.
Figure 1:
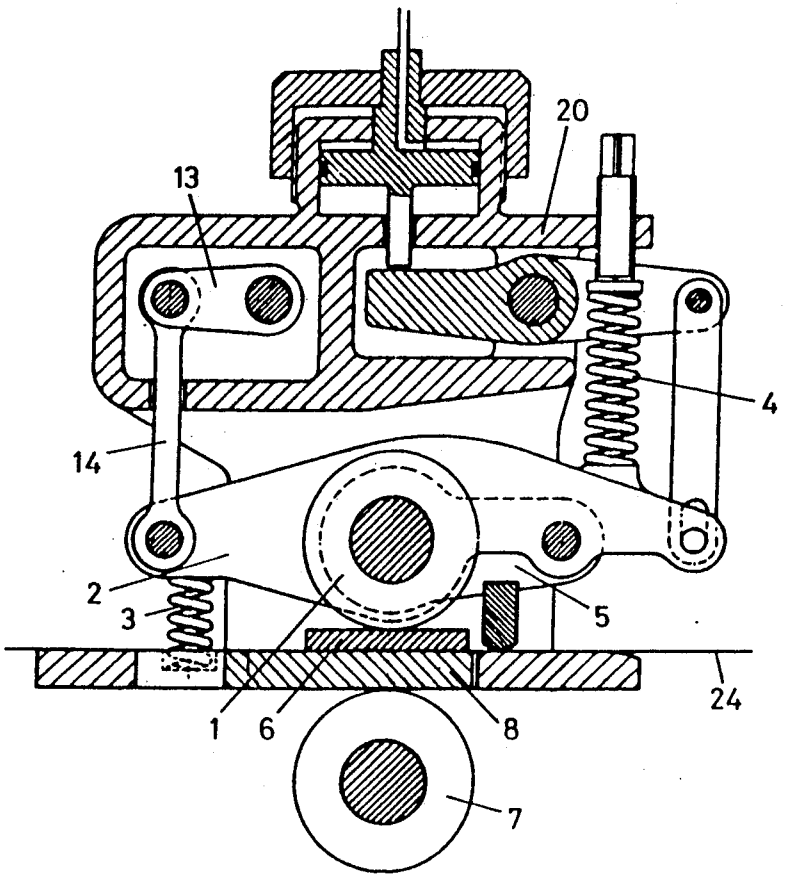
FIG. 1 is a sectional view of a portion of a workpiece advancing or feeding, unit.

For a better understanding of the invention, initially the general operating of the apparatus for a stepwise advancing of a web-shaped workpiece will be described herein below. The drive of the apparatus proceeds via a drive shaft 10 which is drivingly coupled to the drive of the for instance punch press such that this drive shaft 10 rotates in synchronism with the movement of the strokes of the ram of the punch press. There is a control cam 11 on one end of the drive shaft 10. A cam follower 12 is supported on this control cam 11. This cam follower 12 is in turn supported in an arm 13, which is also illustrated in FIG. 1. A rod 14 is hingedly mounted to the arm 13, which rod 14 is pivotally mounted to a so-called rocker 2. This rocker 2 is supported by means of springs 3 and 4 against the frame 20 of the apparatus. The rocker 2 is, furthermore, supported via a pair of arms 5 at the frame 20 of the apparatus. The rocker 2 and the pair of arms 5 are also depicted in FIG. 2.

An upper roller 1 is rotatably supported in the rocker 2. In the operational position illustrated in FIGS. 1 and 2, this upper roller 1 lies on an elastically movable clamp 6. This clamp 6, i.e. the jaw of the entire "pliers" is movable against a slide 8 which is supported on a lower, stationary roller 7, which is mounted for rotation only in the frame, i.e., it is not rectilinearly movable. The structural members described so far are e.g., disclosed in the Swiss patent application 3984/88-1. The further individual structural members illustrated in FIG. 1 are of no importance regarding the understanding of the present invention.

In operation the drive shaft 10 rotates and accordingly the control cam 11 rotates too. Due to the cam follower 12 the arm 13 conducts a pivoting movement, wherewith the rod 14 is vertically moved up-and-downwards. This rod 14 causes in turn the rocking movement of the rocker 2 such that generally the upper roller 1 is moved against the clamp 6 for a clamping of the web-shaped workpiece and accordingly also moved away therefrom.

Figure 3:
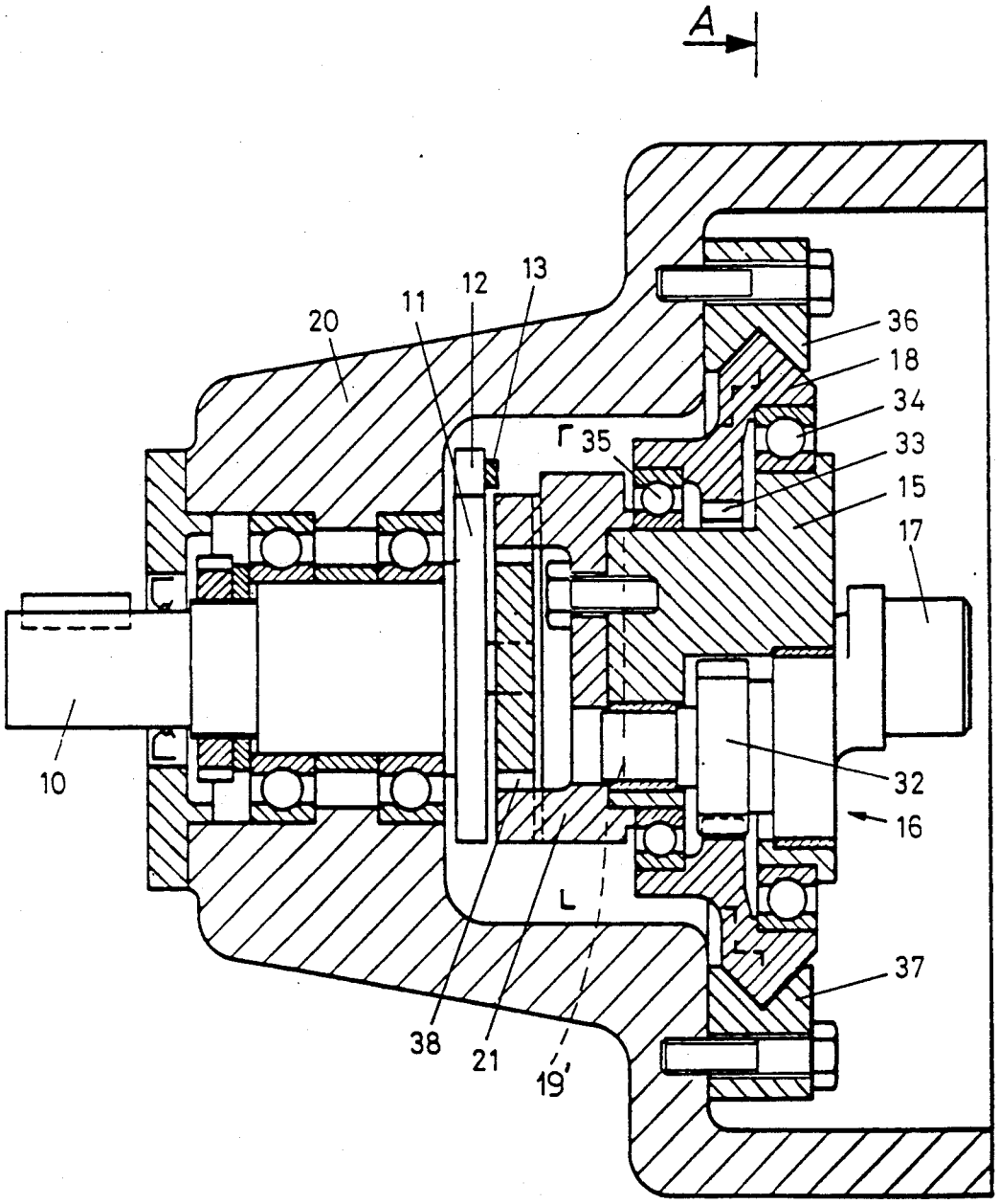
FIG. 3 is a sectional view of an embodiment of the invention.

The oscillating movement for the advancing or feeding, respectively, of the web-shaped workpiece 24 is produced by a crank drive assembly 16 (FIG. 3) which is supported eccentrically such in an intermediate shaft 15 that during the rotating of the drive shaft 10 its driving pivot 17 makes an oscillating movement. The eccentric supporting of a crank drive for producing an oscillating movement of its driving pivot is a generally known design and accordingly no detailed description thereof is needed. The driving pivot 17 of the crank assembly 16 illustrated in FIG. 3 is also illustrated in FIG. 2, which represents one of the many possibilities for producing the oscillating movement. The driving pivot 17 is rigidly mounted to a rocker arm 26 which is pivotally supported in a bearing 27. A slide ring 28 is supported in the opposite end of the rocker arm 26 and a pin 29 of a crank 30 is inserted in this slide ring 28 This crank 30 is on the one hand rigidly mounted to the lower roller 7 and comprises on the other hand at its top area a toothed segment 31 which meshes with a rack 9 that is movable in its longitudinal direction, which rack 9 is in turn rigidly mounted to a slide 8 forming the lower part ("lower jaw") of the clamp.

In operation, i.e., during rotation of the drive shaft 10 the driving pivot 17 of the crank assembly 16 is subjected to an oscillating movement such that the rocker arm 26 pivots around the bearing 17, such that the crank 30 makes an oscillating movement due to the pin 29 projecting into the slide ring 28. It is now obvious that the oscillating movement is made by the lower roller 7, see FIGS. 1 and 2. In this specific embodiment illustrated, the upper roller 1 is supported for free rotation whereby the feeding movement is caused by the toothed segment 31 of the crank 30 acting in the last place onto the slide 8.

It has been mentioned above that the seeming rest period at the end position of the oscillating movement is extremely short amounting to a very small amount of angular degrees in known feeding apparatuses having a crank drive such that on the one hand the "resting period" of the movable structural members including the web-shaped workpiece is very short to such an extent that the elastic, dynamic deformation cannot attenuate completely and that also possible oscillations cannot attenuate or fade out completely. The oscillating movement of the structural members for the feeding is now basically caused by the driving pivot 17 of the crank assembly 16, which according to the above mentioned is a resting only during a period of very few angular degrees.

Figure 4:
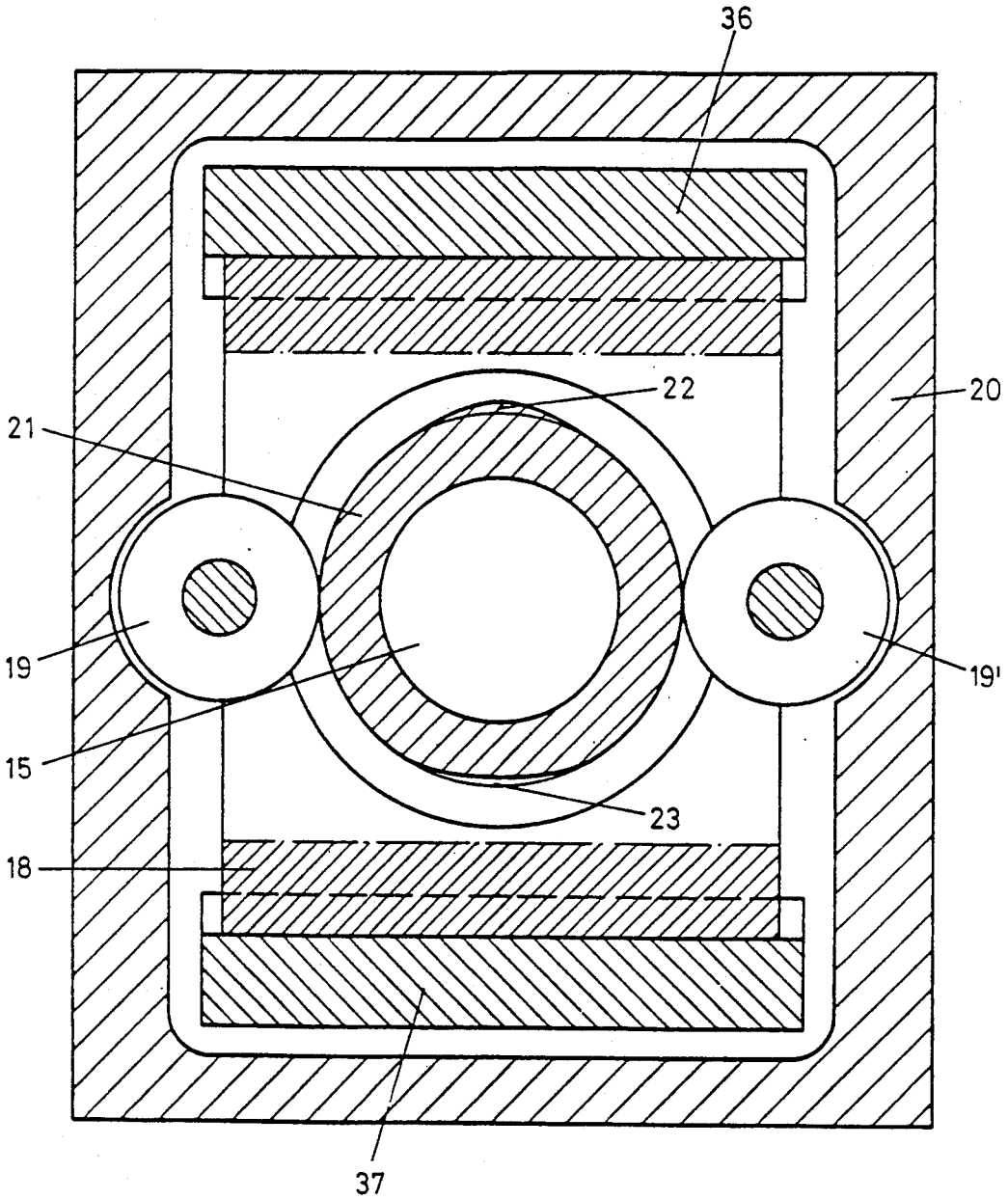
FIG. 4 is a section along line A—A of FIG. 3.

Reference is now made specifically to FIGS. 3 and 4. The crank assembly 16 is supported eccentrically in an intermediate shaft 15 and includes a section 32 having radial serrations, which serrated section meshes with an internal toothing 33 of the intermediate shaft 15 such that when the intermediate shaft 15 rotates, the driving pivot 17 makes, as is generally known in such designs, a reciprocating oscillating movement. The intermediate shaft 15 is in turn supported via roller bearings 34, 35 in a slide 18. This slide 18 is supported for a rectilinear reciprocating movement in guide pieces 36, 37. The direction of movement proceeds accordingly based on FIG. 3 perpendicularly to the drawing sheet towards the viewer and away from the viewer.

At its left end the intermediate shaft is mounted to a cam disk 21, which in turn is mounted via a cross-type disk 38 to the drive shaft 10.

The cam disk 21 is guided between two cam rollers 19, 19' (see FIG. 4), which cam rollers 19, 19' are supported stationary in the frame 20. The cam disk 21 includes a peripheral control surface, i.e. a guide surface, which is of a generally circular shape and includes a projecting section 22 and a recessed section 23 located diametrically opposite of the projecting section 22. Accordingly, it is obvious from FIG. 4 that when the cam disk 21 rotates, it makes due to the cam rollers 19, 19' and the projecting section 22 as well as the recessed section 23 an oscillating, horizontal movement, which movement is transmitted via the intermediate shaft 15 onto the slide 18.

Accordingly, it can be seen (see FIG. 3) that the oscillating movement of the slide 18 is super-imposed over the oscillating movement of the driving pivot 17. Thereby the cam disk 21 and specifically its projecting section 22 and recessed section 23 are designed and arranged such that the intermediate shaft 15 is subjected to a movement directed oppositely to such of the driving pivot 17 of the crank drive, which movement additionally proceeds during a larger angle of movement of the crank. Furthermore, the sum of these two movements amounts in the periods or locations of the respective end positions to zero, i.e. the driving pivot 17 is at rest during a longer time span or longer period, respectively, (e.g., 30° angle of movement of crank). Accordingly, the dynamic deformations occurring at high rotational speeds and possible oscillations of the structural members of the apparatus as well as of the web-shaped workpiece being fed can attenuate and fade out prior to the punching or embossing proper, respectively, and furthermore, those structural members which in order to clamp the web-shaped workpiece are lowered against the workpiece and impinged thereupon can be lowered at lower speed, such that a smaller speed of impingement or smaller energy of impingement, respectively, is produced, wherewith a plastic deformation of the web-shaped workpiece is counteracted.

While there is shown and described a present preferred embodiment of the invention, it is to be distinctly understood that the invention is not limited thereto, but may be otherwise variously embodied and practiced within the scope of the following claims.

I claim:

1. An apparatus for a stepwise advancing of a web-shaped workpiece, which apparatus includes two workpiece advancing units operative to clampingly receive a workpiece therebetween, of which two workpiece advancing units the first workpiece advancing unit is periodically movable towards the second workpiece advancing unit such to periodically clamp a workpiece therebetween and being periodically movable away from the second workpiece advancing unit such to release the workpiece, and which apparatus includes further a drive shaft and a first intermediate drive transmitting assembly driven by said drive shaft and drivingly connected to said first workpiece advancing unit, and a second intermediate drive transmitting assembly driven by said same drive shaft and drivingly connected to said second workpiece advancing unit, said first intermediate drive transmitting assembly comprising a cam drive driven by said drive shaft and drivingly connected via a transmission rod assembly to said first workpiece advancing unit and operative to control the sequence of the movement of said first workpiece advancing unit against said second workpiece advancing unit and away therefrom, and which second intermediate drive transmitting unit comprises a crank assembly having a driving pivot and supported such in an intermediate shaft, which is drivingly connected to said drive shaft to be driven therefrom, that the driving pivot which is operative to drive said second workpiece advancing unit executes in operation an oscillating movement, which intermediate shaft is supported in a slide which is oscillatory opposite to the oscillating movement of said driving pivot.

2. The apparatus of claim 1, in which said intermediate shaft comprises an oscillatory cam disk supported via at least one stationary cam follower roller against the frame of the apparatus, which oscillatory cam disk causes via said intermediate shaft the oscillating movement of said slide directed oppositely to the oscillating movement of said driving pivot of said crank assembly.

3. The apparatus of claim 2, in which said cam disk comprises a circular peripheral surface abutting said at least one cam follower roller , which peripheral surface includes along the periphery a projecting section and diametrically opposite thereof a recessed section such that said slide oscillates merely at the end position region of the oscillating movement of the driving pivot of the crank assembly in an opposite direction thereto.

* * * * *